US006390361B1

(12) United States Patent
Gund

(10) Patent No.: US 6,390,361 B1
(45) Date of Patent: May 21, 2002

(54) CASH DRAWER PROTECTION SYSTEM HAVING AN EMERGENCY AND AN ACTIVE CASH DRAWER

(76) Inventor: Sonja S. Gund, PO Box 38266, Colorado Springs, CO (US) 80937

( * ) Notice: Subject to any disclaimer, the term of this patent is extended or adjusted under 35 U.S.C. 154(b) by 0 days.

(21) Appl. No.: 09/429,085

(22) Filed: Oct. 29, 1999

(51) Int. Cl.[7] ..... G07G 1/00
(52) U.S. Cl. ..... 235/7 R; 235/10; 235/22
(58) Field of Search ..... 235/22, 7 R, 10

(56) References Cited

U.S. PATENT DOCUMENTS

| | | | | |
|---|---|---|---|---|
| 4,035,792 A | * | 7/1977 | Price et al. | 340/277 |
| 4,366,997 A | * | 1/1983 | Lopez et al. | 312/204 |
| 4,369,717 A | * | 1/1983 | Bollier | 109/45 |
| 4,937,744 A | * | 6/1990 | Ball | 364/405 |
| 5,615,624 A | * | 4/1997 | Terry et al. | 109/19 |

FOREIGN PATENT DOCUMENTS

| | | | |
|---|---|---|---|
| DE | 3426749 A | * | 7/1984 |

* cited by examiner

*Primary Examiner*—Karl D. Frech
(74) *Attorney, Agent, or Firm*—G. F. Gallinger

(57) ABSTRACT

A method of protecting an active cash drawer from robbery comprising the following steps: housing the active cash drawer together with an emergency cash drawer in a housing having a frontal opening to accommodate the opening of a cash drawer; arranging for the active cash drawer to open through the frontal opening in the housing to facilitate routine cash transactions; generating an alarm signal in the event of a robbery and arranging for the emergency cash drawer to open instead of the active cash drawer subsequent to the alarm signal. In a preferred embodiment of the invention the frontal opening is generally the height of a cash drawer and the cash drawers vertically shift upwards within the housing subsequent to the alarm signal so that the active cash drawer is aligned behind the frontal opening prior to the alarm signal and the emergency cash drawer is in alignment with the frontal opening subsequent thereto.

6 Claims, 1 Drawing Sheet

CASH DRAWER PROTECTION SYSTEM HAVING AN EMERGENCY AND AN ACTIVE CASH DRAWER

FIELD OF THE INVENTION

This invention relates to cash drawers in banks, and cash registers in retail outlets, which are used to make change and receive cash from the public. More particularly this invention relates to a cash drawer protection system which utilises an emergency cash drawer which opens in place of an active cash drawer in the event of a robbery.

BACKGROUND OF THE INVENTION

There is a need for a more secure cash drawer. Banks and other businesses conducting cash transactions with the public are using cash drawers and cash registers with very little security built into them. Convenience stores and gas stations frequently find it necessary to operate with so little cash that they are unable to make change if they receive $20. in payment of a purchase. A more secure cash register is needed.

OBJECTS OF THE INVENTION

It is an object of this invention to disclose a cash drawer protection system which will make cash drawers and cash registers more secure. A cash drawer protection system that would allow businesses to more securely keep sufficient cash for transactions without the existing fears of loosing that cash in the event of a robbery. It is yet a further object of this invention to disclose a system which facilitates the delivery of marked bills to a thief in a robbery.

One aspect of this invention provides for a method of protecting an active cash drawer from robbery comprising the following steps: housing the active cash drawer together with an emergency cash drawer in a housing having a frontal opening to accommodate the opening of a cash drawer; arranging for the active cash drawer to open through the frontal opening in the housing to facilitate routine cash transactions; and finally generating an alarm signal in the event of a robbery and arranging for the emergency cash drawer to open instead of the active cash drawer subsequent to the alarm signal.

A preferred aspect of this apparatus provides for a method as above wherein the frontal opening is generally the height of a cash drawer and the cash drawers vertically shift upwards within the housing subsequent to the alarm signal so that the active cash drawer is aligned behind the frontal opening prior to the alarm signal, and the emergency cash drawer is in alignment with the frontal opening subsequent thereto.

Various other objects, advantages and features of this invention will become apparent to those skilled in the art from the following description in conjunction with the accompanying drawings.

FIGURES OF THE INVENTION

Figure 1:
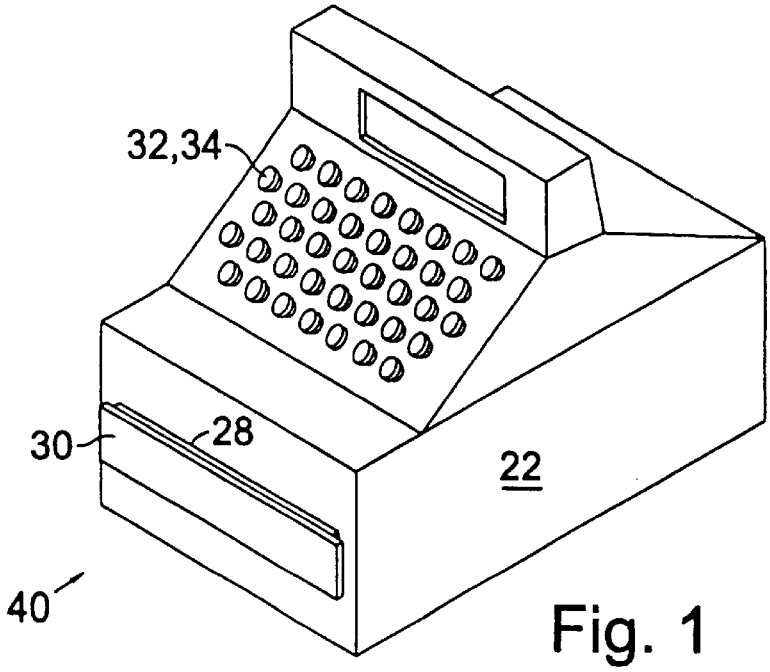
FIG. 1 is a perspective view of a cash drawer in a housing which comprises a cash register.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
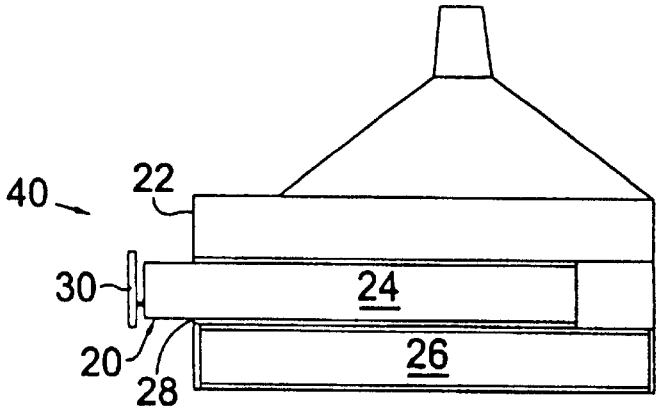
FIG. 2 is a cross sectional view of the cash register shown in FIG. 1.

Turning now to the drawings and more particularly to FIG. 1 we have a perspective view of a cash drawer 20 in a housing 22 which comprises a cash register 40. FIG. 2 is a cross sectional view of the cash register 40 shown in FIG. 1. A method of protecting an active cash drawer 24 from robbery comprising the following steps: housing the active cash drawer 24 together with an emergency cash drawer 26 in a housing 22 having a frontal opening 28 to accommodate the opening of a cash drawer 24,26; arranging for the active cash drawer 24 to open through the frontal opening 28 in the housing 22 to facilitate routine cash transactions; devising an alarm signal means 32,34 in the event of a robbery and finally; arranging for the emergency cash drawer 24 to open instead of the active cash drawer 26 subsequent to the alarm signal.

Figure 3:
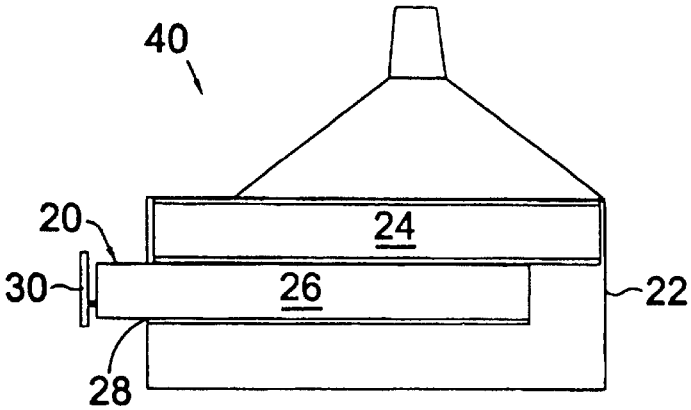
FIG. 3 is a cross sectional view of the cash register shown in FIG. 2 after an alarm signal has been generated.

In a preferred embodiment of the invention the frontal opening 28 is generally the height of a cash drawer 20 and the cash drawers 24,26 vertically shift within the housing 22 to align one of the drawers 24,26 behind the frontal opening 28 so that prior to the alarm signal the active cash drawer 24 is in alignment with the frontal opening 28 and subsequent thereto the emergency cash drawer 26 is in alignment with the frontal opening 28. Most preferably the active cash drawer 24 is positioned above the emergency cash drawer 26, and subsequent to the alarm signal both drawers 24,26 shift upwards in the housing 22 before the emergency drawer 26 becomes aligned with the frontal opening 28. FIG. 3 is a cross sectional view of the cash register shown in FIG. 2 after an alarm signal has been generated. The drawers 24,26 have shifted upwardly, and the emergency cash drawer 26, after coming into alignment with the frontal opening 28 has opened.

In the most preferred embodiment of the invention the frontal opening 28 is covered by a common front panel 30 which alternatively can engage either of the cash drawers 24,26 so that the common front panel 30 will slide forward and open with either drawer 24,26 behind it. This common front panel 30 thereby makes the vertical shifting of the drawers 24,26 unnoticeable from outside the housing 22 subsequent to the alarm signal.

It is contemplated that the cash drawers 24,26 will slidably spring open when released. It is contemplated that the housing 22 will generally exceed three times the height of a single drawer 20 so that the housing 22 can thereby accommodate two stacked drawers 24,26 and allow those drawers 24,26 to vertically shift the height of a single drawer 20.

The housing 22 may be an integral portion of a cash register 40. In this event the alarm signal means would comprise a designated key 34 of standard shape and design on the cash register 40. The designated key 34 could in addition to opening the emergency cash drawer 26, be simultaneously used to commence videotaping, call the police, and begin other protective measures.

While the invention has been described with preferred specific embodiments thereof, it will be understood that this description is intended to illustrate and not to limit the scope of the invention, which is defined by the following claims:

I claim:

1. A method of protecting an active cash drawer from robbery comprising the following steps:

housing the active cash drawer together with an emergency cash drawer in a housing having a frontal opening which generally has a height of a cash drawer to accommodate the opening of a cash drawer;

providing for the cash drawers to vertically shift within the housing to selectively align one of the drawers behind the frontal opening;

arranging for the active cash drawer to be in alignment with, and open through the frontal opening to facilitate routine cash transactions; and, devising an alarm signal means which will generate an alarm signal in the event of a robbery and subsequently cause the emergency cash drawer to shift vertically into alignment with, and open through the frontal opening, instead of the active cash drawer.

2. A method as in claim 1 wherein the active cash drawer is positioned above the emergency cash drawer, and subsequent to the alarm signal both drawers shift upwards in the housing before the emergency drawer becomes aligned with the frontal opening.

3. A method as in claim 2 wherein the frontal opening is covered by a common front panel which alternatively can engage either of the cash drawers thereby making vertical shifting unnoticeable subsequent to the alarm signal from outside the housing.

4. A method as in claim 2 wherein the housing generally exceeds three times a height of a single drawer so that the housing can accommodate two stacked drawers and allow those drawers to vertically shift the height of a single drawer.

5. A method as in claim 1 wherein the housing is an integral portion of a cash register.

6. A method as in claim 1 wherein the alarm signal means comprises a designated key of standard shape and design on the cash register.

* * * * *